US007128245B2

(12) United States Patent
Lee

(10) Patent No.: US 7,128,245 B2
(45) Date of Patent: Oct. 31, 2006

(54) DISPENSING CLOSURE WITH AUTOMATIC SEALING VALVE OF SINGLE BODY

(75) Inventor: Chung Kee Lee, Seoul (KR)

(73) Assignee: Chong Woo Co., LTD, Inchon (KR)

( * ) Notice: Subject to any disclaimer, the term of this patent is extended or adjusted under 35 U.S.C. 154(b) by 127 days.

(21) Appl. No.: 10/630,631

(22) Filed: Jul. 29, 2003

(65) Prior Publication Data

US 2004/0262338 A1 Dec. 30, 2004

(30) Foreign Application Priority Data

Jun. 30, 2003 (KR) ..... 2003-0043677

(51) Int. Cl.
*B65D 37/00* (2006.01)

(52) U.S. Cl. ..... 222/212; 222/490; 222/494; 222/562

(58) Field of Classification Search ..... 222/212, 222/494, 490, 325, 328, 335, 531, 556, 562, 222/213–215, 491
See application file for complete search history.

(56) References Cited

U.S. PATENT DOCUMENTS 1,607,993 A 11/1926 Loewy
2,802,607 A 8/1957 Kalmbach, Jr., et al. .... 222/490
3,257,046 A 6/1966 Kasson ..... 222/490
5,271,531 A * 12/1993 Rohr et al. ..... 222/212
5,676,289 A * 10/1997 Gross et al. ..... 222/494
6,089,419 A * 7/2000 Gross ..... 222/494
6,112,951 A * 9/2000 Mueller ..... 222/490
6,145,688 A * 11/2000 Smith ..... 220/259.3

FOREIGN PATENT DOCUMENTS

DE 299 13 319 U 1/2001

* cited by examiner

*Primary Examiner*—Frederick C. Nicolas
(74) *Attorney, Agent, or Firm*—Ladas & Parry LLP

(57) ABSTRACT

The present invention relates to a dispensing closure which includes an automatic sealing valve which opens to dispense a fluid product from a squeeze-type container when the container is subjected to an external force, such as squeezing pressure, and which automatically closes when the external force is terminated, and a closure body which securely mounts the automatic sealing valve to the container, wherein the automatic sealing valve and the closure body are designed in a special form not to need a means for retaining the automatic sealing valve to the closure body, so that the possibilities of defect thereof in manufacture and disorder during use can be remarkably reduced, and the manufacturing cost can be reduced by shortening an assembling process.

5 Claims, 7 Drawing Sheets

DISPENSING CLOSURE WITH AUTOMATIC SEALING VALVE OF SINGLE BODY

TECHNICAL FIELD

The present invention relates generally to closures, and more particularly to a dispensing closure which includes an automatic sealing valve which opens to dispense a fluid product from a squeeze-type container when the container is subjected to an external force, such as squeezing pressure, and which automatically closes when the external force is terminated, and a closure body which securely mounts the automatic sealing valve to the container, wherein the automatic sealing valve and the closure body are designed in a special form not to need a means for retaining the automatic sealing valve to the closure body, so that the possibilities of defect thereof in manufacture and disorder during use can be remarkably reduced, and the manufacturing cost can be reduced by shortening an assembling process.

BACKGROUND OF THE INVENTION

Dispensing devices, discharging a predetermined amount of fluid product in a container when required, have been developed in a variety of types due to their convenience in use. One type of them is a manual pump-type dispenser that comprises cylinder, piston, spring, nozzle, etc. and is engaged to the upper of a container for use. The manual pump-type dispenser discharges a fluid product through the nozzle when the pump is pressed downwardly.

The other type of them is a dispensing closure with an automatic sealing valve. The dispensing closure discharges a fluid product through the automatic sealing valve that opens when a container is subjected to an external force, such as a squeezing force, and then automatically closes by the inherent resilience thereof when the external force is released. Such automatic sealing valves are disclosed in U.S. Pat. Nos. 1,607,993, 2,802,607, 3,257,046, etc.

Many structural configurations of the dispensing closure have been developed with these automatic sealing valves for more convenience in use. A representative example is disclosed in U.S. Pat. No. 5,271,531, issued on Dec. 21, 1993 to Rohr et al., entitled "DISPENSING CLOSURE WITH PRESSURE-ACTUATED FLEXIBLE VALVE," which includes a cylindrical closure body, a flexible self-sealing valve (automatic sealing valve), a retaining ring, a central support member, etc. The retaining ring is adapted to be disposed in a collar of the closure body so as to prevent the self-sealing valve from being upwardly dislodged during operation. Also, the dispensing closure is provided with the central support member, having an upwardly facing concave surface that is surrounded by a flat, annular, peripheral surface, within a dispensing aperture for supporting the dispensing valve, thereby preventing the self-sealing valve from being downwardly dislodged during operation. However, this structural configuration has some drawbacks as below.

First, the structural configuration according to the above patent requires the retaining ring. Nevertheless, the possibility of dislodgement of the automatic sealing valve continuously exists because the self-sealing valve is so flexible that it can be too largely deformed during operation, thereby causing the upwardly dislodgement thereof. In particular, the dispensing closure with the automatic sealing valve is usually used in a reverse position, i.e., the opening thereof facing downwardly, and in this position, some fluid product in a container may enter the gap between the dispensing closure and the automatic sealing valve to help dislodgement of the valve by working as a lubricant. Moreover, where a defect occurs in the retaining ring in a manufacturing and/or assembling processes, it is very difficult to disassemble the retaining ring without causing any damage in the automatic sealing valve, because the retaining ring need to be strongly attached to the dispense closure for preventing the possibility of dislodgement as described above.

Second, the structural configuration according to the above patent also requires the separate, supporting member to prevent the automatic sealing valve from being downwardly dislodged during operation. The automatic sealing valve generally has the similar thickness through an opening of the closure body and thus the downward pressure is uniformly applied to the top surface of the valve, exposed through the opening, when the squeezing pressure is released. In other words, the downward pressure does not concentrate at a certain area of the automatic sealing valve, so that a relatively high force is applied to the portion between the closure body and the automatic sealing valve, which can cause the automatic sealing valve to be dislodged downwardly. As a result, the supporting member is required.

The need of the retaining ring and supporting member for configuration of dispensing closure causes complication of manufacturing and assembling steps, which also causes the possibility of its defect and disorder as well as the manufacturing cost to increase.

In accordance with the present invention, an automatic sealing dispensing closure is provided which substantially reduces or eliminates disadvantages and problems associated with prior art dispensing closures. That is, an object of the present invention is to provide a dispensing closure which can be actuated even without any separate retaining means and supporting means by making a closure body and automatic sealing valve in a special form so as to reduce the number of components and shorten the manufacturing and assembling processes. Another object of the present invention is to provide a dispensing closure that has an excellent sealing effect and very low possibilities of defects in manufacture and disorders during use.

SUMMARY OF THE INVENTION

In accordance with the present invention, a dispensing closure is provided which comprises a closure body adapted to be assembled to the opening of a container, said closure body defining a dispensing passage for communication between the container interior and exterior through the container opening; and an automatic sealing valve disposed in said closure body across said dispensing passage, said valve opening in response to increased container pressure and automatically closing in response to released container pressure, and comprising;

(a) said closure body having a cylindrical body for attachment to said container, a horizontal covering part extending inwardly from the top of said cylindrical body, a vertical covering part extending upwardly from the inner end of said horizontal covering part, and a top covering part extending inwardly from the upper end of said vertical covering part and protruding downwardly at its lower surface, which forms a generally tubular spout; and (b) said automatic sealing valve having a static member for engagement in the inside space made by said horizontal covering part, vertical covering part and top covering part of said closure body, and a dynamic member for being movable by pressure within said container between an open position and a closed position;

wherein said static member comprises a horizontal part corresponding to said horizontal covering part and a vertical part corresponding to said vertical covering part, and said dynamic member comprises a flexible lateral part extending inwardly from the top of said vertical part and then bending downwardly, and an automatic sealing part extending inwardly from said flexible lateral part and having a central opening-closing slit; and wherein the top surface of a connect portion between said vertical part and said flexible lateral part have a generally V-shaped groove, and the thickness of said flexible lateral part is less than ⅓ of the thickness of said vertical part and simultaneously less than ⅓ of the thickness of the peripheral portion of said automatic sealing part, and the top surface of said automatic sealing part forms the shape of a reverse dome, and the outer, peripheral surface of said automatic sealing part slopes outwardly, downwardly at least 5° from its vertical axis.

Terms in the present invention, such as "upward", "downward", are used to describe the direction of elements in the upright position of the container regardless of real operating position. Term "inward" is used to mean the direction toward the central axis of the container, and term "outward" is used to mean its opposite direction.

In a particular embodiment, said cylindrical body of the closure body further includes an annular, small ring which protrudes inwardly from the inner surface of the cylindrical body with which said horizontal part of the automatic sealing valve comes into contact. Said ring serves to support the horizontal part of the automatic sealing valve to effect its tight engagement within the cylindrical body.

In another particular embodiment, said dispensing closure further includes a cap for protection of said automatic sealing valve and being connected to said cylindrical body of the closure body through a snap hinge, said cap having a central post which is disposed within the reverse dome-typed cavity of said automatic sealing valve when the cap is closed thereover.

One of important features of the present invention is that the automatic sealing valve can be securely engaged to the closure body without requiring any retaining means, such as a retaining ring in prior art, and is not dislodged from the closure body during use due to their special structural configuration. Furthermore, this structural configuration provides tighter engagement and more effective sealing than any structural configurations in prior art. In addition, the reduced number of constitutional elements, based upon this structural configuration, can significantly reduce the possibility of defect in manufacture and disorder in use as well as the manufacturing cost.

The present invention will be better understood with reference to the following embodiments which are intended for purposes of illustration and are not to be construed as in any way limiting the scope of the present invention, which is defined in the claims appended hereto.

DESCRIPTION OF THE PREFERED EMBODIMENTS

While the present invention is susceptible of embodiment in many different forms, this specification and accompanying drawings disclose only some specific forms as examples of the invention. Accordingly, the present invention is not intended to be limited to the embodiments so described.

Figure 1A:
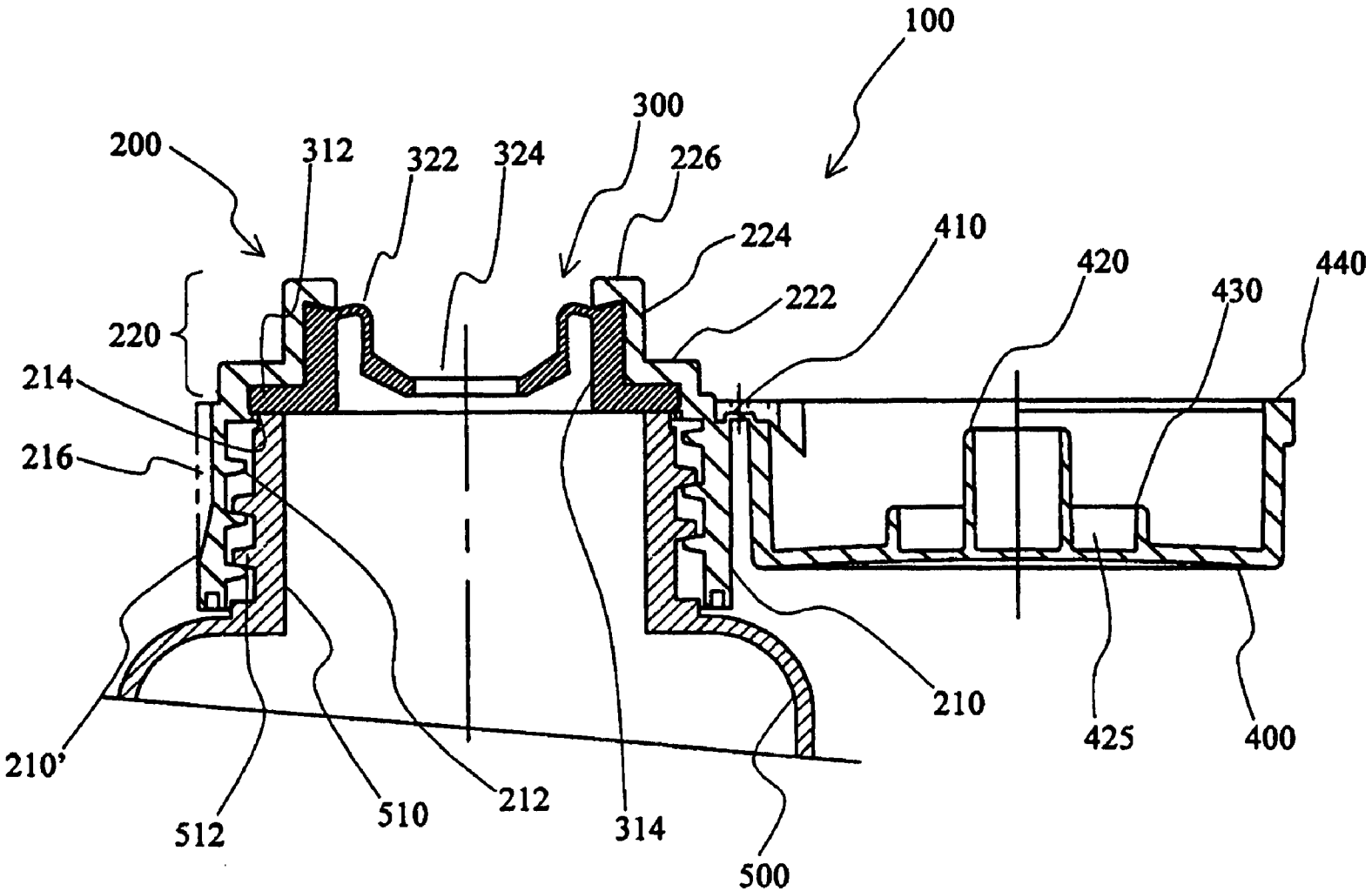
FIGS. 1A and 1B illustrate cross sectional side views of a dispensing closure that accommodates a cap, according to a particular embodiment of the present invention, wherein the cap is in an open position in FIG. 1A and in a closed position in FIG. 1B, respectively.
Figure 1B:
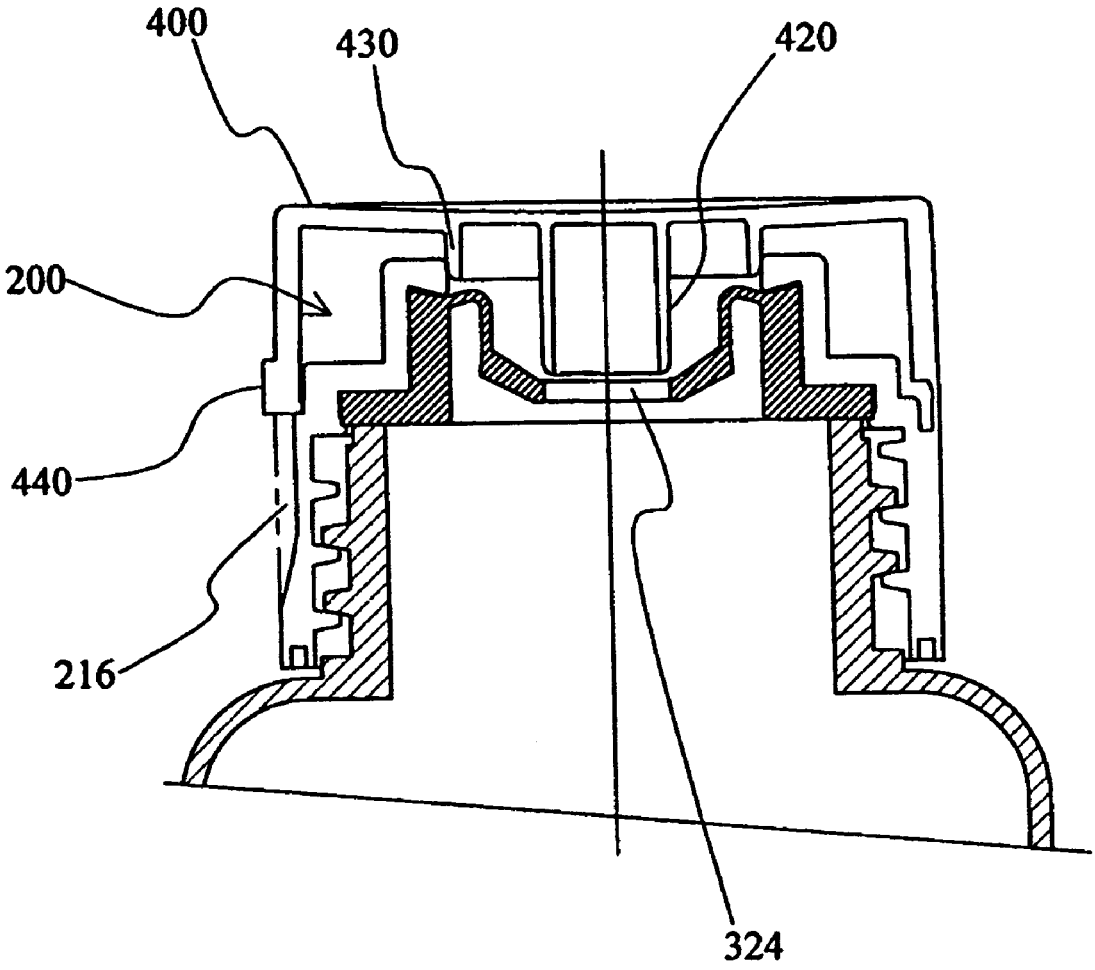

FIGS. 1A and 1B illustrate a cross-sectional side view of a particular embodiment of a dispensing closure 100 according to the present invention, in an open cap position and closed cap position, respectively. The dispensing closure 100 in FIGS. 1A and 1B comprises a closure body 200 and an automatic sealing valve 300, and a cap 400 is connected to the closure body 200 through a snap hinge 410.

The closure body 200 generally comprises a cylindrical body 210 and a tubular spout 220. The cylindrical body 210 is attached to an opening 510 of a container 500. For tight attachment, the cylindrical body 210 includes an internal thread 212 for threadedly attaching the closure body 200 to an external thread 512 of the opening 510. However, ways for attaching the closure body 200 to the container 500 are not limited this thread way but can be diverse ones.

The spout 220 of the closure body 200 has a smaller diameter than the cylindrical body 210. That is, the spout 220 comprises a horizontal covering part 222 extending inwardly from the top of the cylindrical body 210, a vertical covering part 224 extending upwardly from the inner end of the horizontal covering part 222, and a top covering part 226 extending partially, inwardly from the upper end of the vertical covering part 224, thereby generally making a multistage structure which is axially penetrated. This configuration of the spout 220 permits the automatic sealing valve 300, being disposed within the spout 220, to closely contact thereinto and also prevents the automatic sealing valve 300 from being dislodging therefrom during operation even without a separate retaining means, which is different from any prior art configurations.

Accordingly, as will be discussed in detail below, a horizontal part 312 of the automatic sealing valve 300 is tightly secured in the space, when the dispensing closure 100 is attached to the container 500, formed by the top of the container opening 510 and the bottom of the horizontal covering part 222 of the spout 220 and the side of the vertical covering part 224.

When a final product is usually manufactured for sale, a fluid product is first poured into the container 500 and then the dispensing closure 100, in which the automatic sealing valve 300 has been disposed, is attached to the opening 510 of the container 500. In view of this manufacturing process, the automatic sealing valve 300 need to be tightly secured within the closure body 200, prior to attachment of the dispensing closure 100 to the container 500. For tighter engagement, the cylindrical body 210 of the closure body 200 may include an annular, small ring 214 which protrudes inwardly from the side of the cylindrical body 210 to which the horizontal part 312 of the automatic sealing valve 300 contacts. By the annular ring 214, when the automatic sealing valve 300 is inserted into the closure body 200, the flexible, automatic sealing valve 300 is somewhat bent and then recovered to be held in place with the annular ring 214.

The automatic sealing valve 300, as previously mentioned in the prior art description, is a small valve that, when the pressure is made in the container 500 by squeezing the container 500, opens to discharge a fluid product from the container 500 and, when the pressure is released, automatically closes. This automatic sealing valve 300 is made of a material being flexible and resilient. The kinds of the material are not particularly limited, but silicone rubber, polyethylene, ethylene-propylene copolymer, etc. are preferable. Among them, silicone rubber is particularly preferable because of its good resilient property. For polyethylene, high density polyethylene (HDPE) and linear low density polyethylene (LLDPE) are more preferable.

The automatic sealing valve 300 of the present invention can be tightly engaged within the closure body 20, without requiring a separate retaining means due to structural features of themselves. The automatic sealing valve 300 having such feature, according to the present invention, has a structural configuration suitable for being fixed in the inside space that is formed by the horizontal covering part 222, the vertical covering part 224 and the top covering part 226 of the closure body 200. More particularly, the automatic sealing valve 300 includes a horizontal part 312 corresponding to the horizontal covering part 222 of the closure body 200, and a vertical part 314 corresponding to the vertical covering part 224 of the closure body 200. Furthermore, the extending length of the top covering part 226 of the closure body 200 is almost identical with the thickness of the vertical part 314 of the automatic sealing valve 300.

Figure 2A:
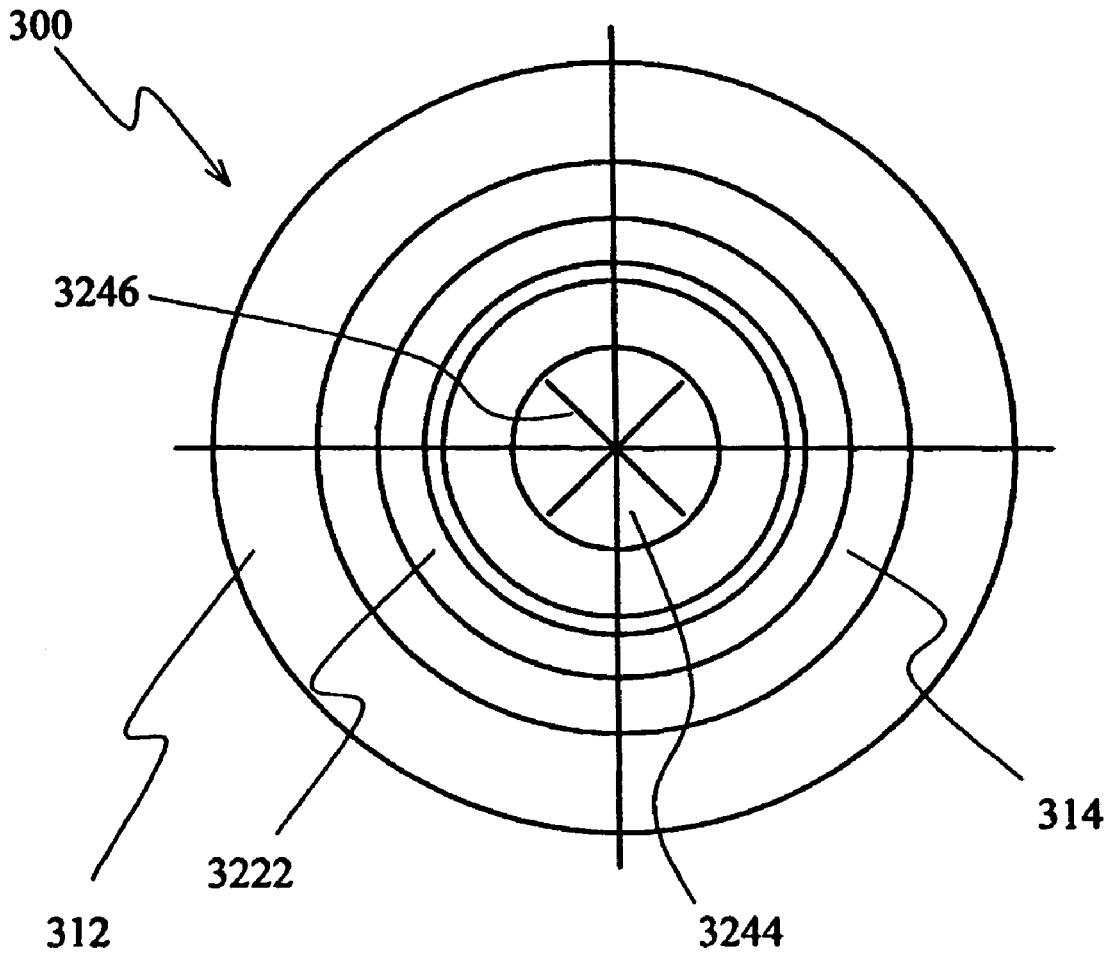
FIG. 2A illustrates a plane view of an automatic sealing valve suitable for a dispensing closure, according to a particular embodiment of the present invention.
Figure 2B:
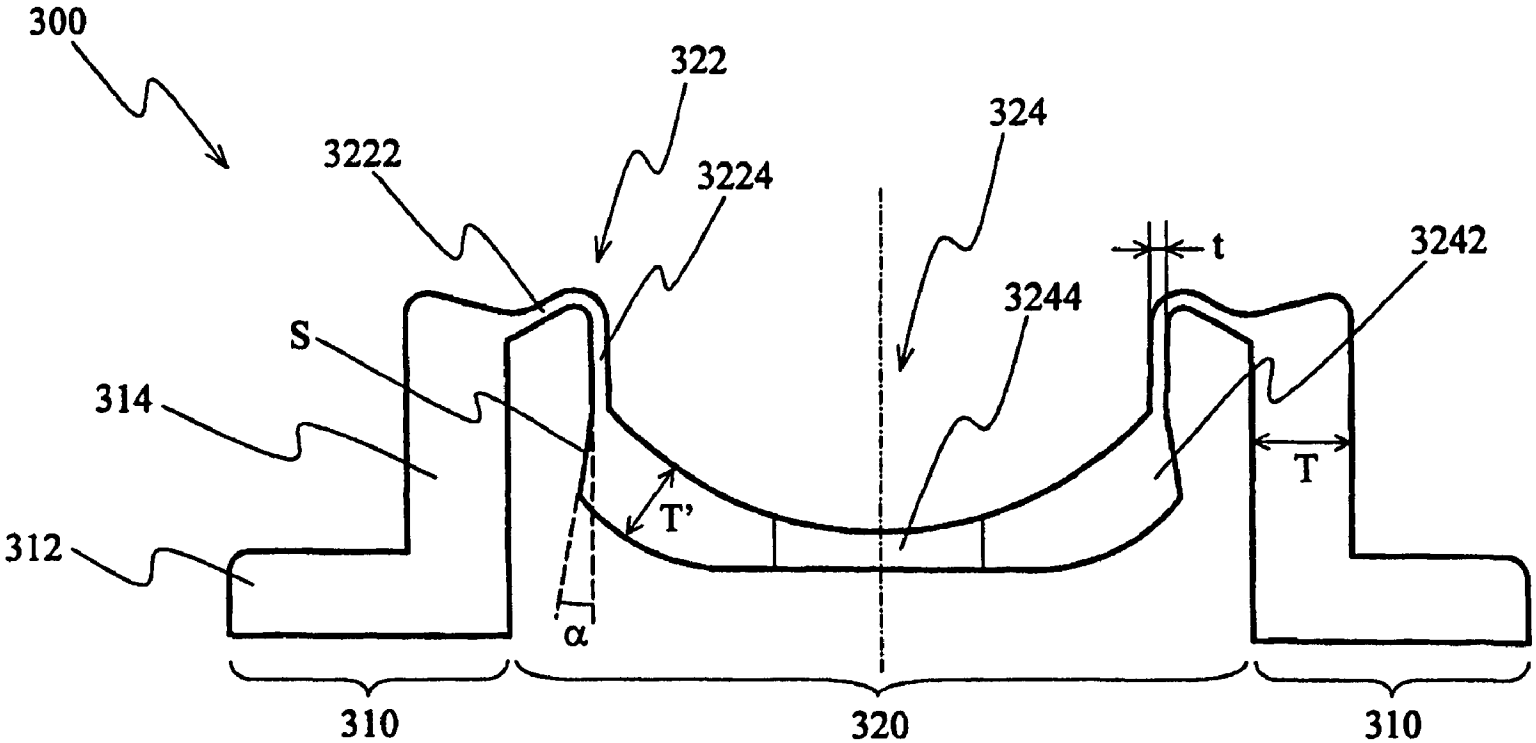
FIG. 2B illustrates a cross sectional side view thereof.

The more precise configuration of the automatic sealing valve 300 is depicted in FIGS. 2A and 2B. The automatic sealing valve 300 can be divided into a static member 310 and a dynamic member 320 by whether of their movement in operation. While the static member 310 does not move in operation and works as fixing the automatic sealing valve 300 into the closure body 200, the dynamic member 320 moves to open and close a passage through the container opening 510 (see FIG. 1A).

More particularly, the static member 310 comprises the horizontal part 312 and the vertical part 314, both having a relatively thick dimension. The horizontal part 312 is positioned in the inside space formed by the closure body 200 and the top of the container opening 510. The horizontal part 312 and the vertical part 314 have an outer surface fitting in the inner surface of the closure body 200, thereby having a high contactability and effecting a tight seal. As a result, there is not a possibility for the fluid product of the container to enter the gap between the closure body 200 and the automatic sealing valve 300. In prior art configurations, as previously mentioned above, the fluid product of the container can work as a lubricant to help an automatic sealing valve come out in operation. Because the automatic sealing valve 300 is made of a flexible material, the horizontal part 312 can be somewhat pressed by the container opening during the assembling process. Accordingly, the thickness of the horizontal part 312 is preferably a little larger than the height of the inside space formed by the closure body 200 and the top of the container opening 510, whereby the horizontal part 312 is somewhat pressed to provide tighter seal.

The dynamic member 320 comprises a flexible lateral part 322, having a relative thin thickness, and an automatic sealing part 324, having an opening-closing slit 3246 in the center. The flexible lateral part 322 comprises a lateral extending part 3222, extending laterally from the top of the vertical part 314, and a vertical extending part 3224, extending downwardly from the lateral extending part 3222. The automatic sealing part 324 comprises a support part 3242, connecting to the vertical extending part 3224, and a central part 3244, having the opening-closing slit 3246.

Figure 3A:
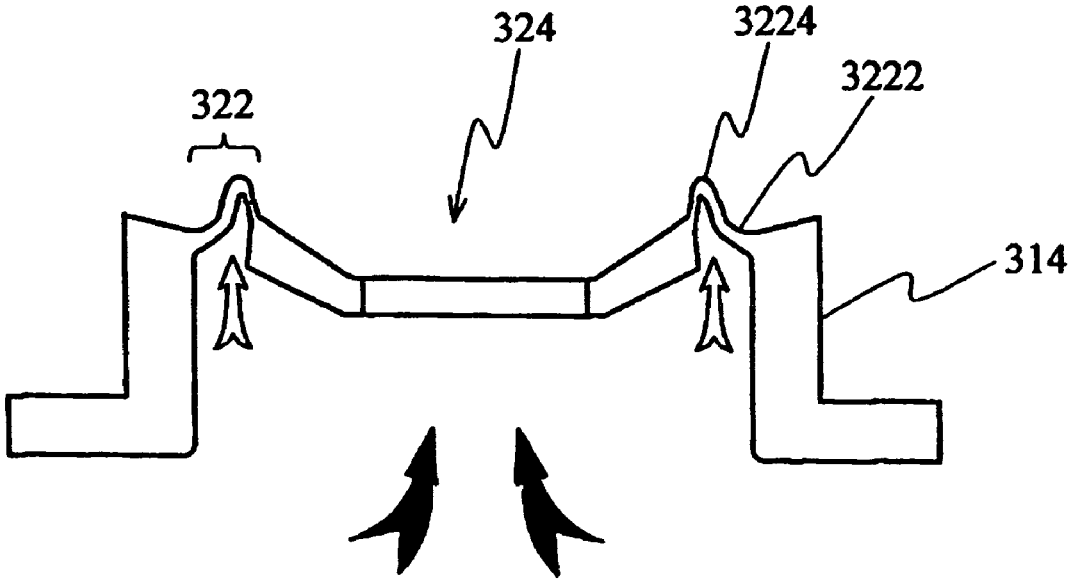
FIGS. 3A and 3B illustrates cross sectional side views of the automatic sealing valve of FIG. 2B, showing partial steps in which the fluid product is being discharged upwardly through an opening-closing slit by the increased pressure within a container.
Figure 3B:
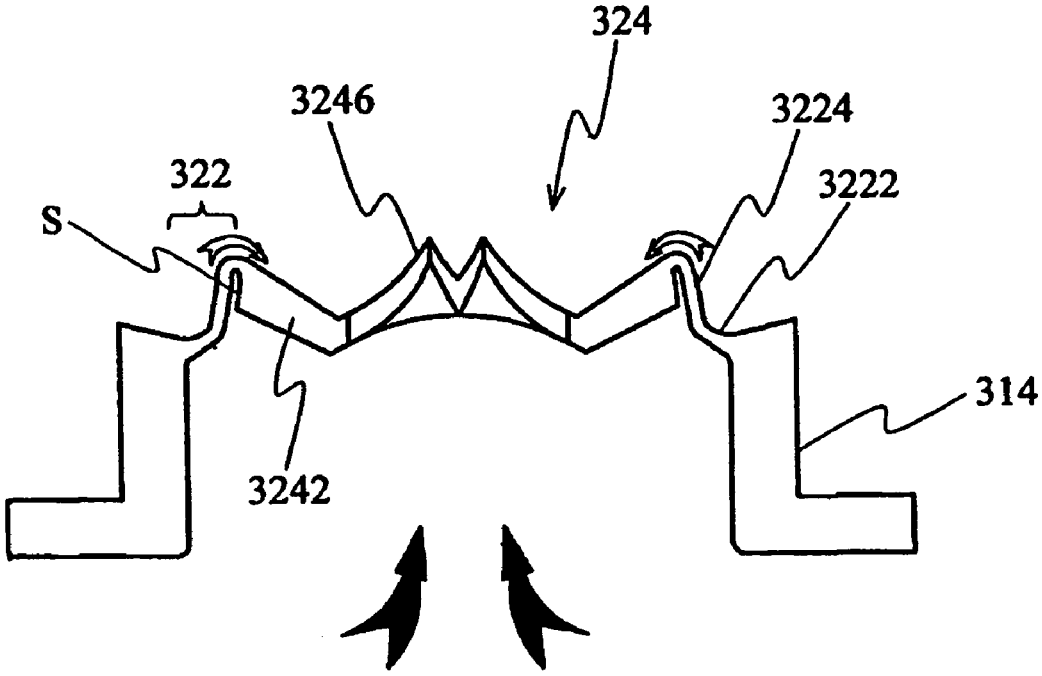

The top of a portion, in which the vertical part 314 of the static member 310 are connected to and the flexible lateral part 322 of the dynamic member 320, is bent in the V-shaped form. This V-shaped groove is occluded with a portion protruding downwardly from the bottom of the top covering part 226 of the closure body 200, which helps the closure body 200 to secure the automatic sealing valve 300. A portion, in which the horizontal extending part 3222 and the vertical extending part 3224 are connected to each other, is made as a curve form. As seen in FIGS. 3A and 3B showing the operation process, when the fluid product is pressurized by squeezing the container, a vertical extending part 3224 is bent somewhat upwardly and the connect portion is unfolded as the vertical extending part 3224 rises, while the vertical extending part 3224 is outwardly folded, so that the automatic sealing part 324 rises. Accordingly, the flexible lateral part 322 is a portion which is temporally, the most largely distorted by the applied pressure. For easier distortion, the thickness (t) of the flexible lateral part 322 is below ⅓, preferably below ¼ of the thickness (T) of the vertical part 314, with reference to FIG. 2. Simultaneously, the thickness (t) of the flexible lateral part 322 is below ⅓, preferably below ¼ of the thickness (T') of the support part 3242, more particularly, the outer portion of the automatic sealing part 324. Where the thickness (t) of the flexible lateral part 322 is out of the above range, the vertical part 314 as well as the flexible lateral part 322 is also distorted in pressure application, whereby the automatic sealing valve 300 can be dislodged from the closure body 200 and, in pressure release, the automatic sealing valve 324 may fail to recover to the original position to cause upwardly convex distortion of the automatic sealing valve 324.

Referring again to FIG. 2B, the top surface of the automatic sealing part 324 is recessed in the form of reverse dome. This structural configuration is also suitable for preventing the automatic sealing part 324 from being upwardly, convexly distorted, when the pressure is applied. Moreover, the outer surface (S) of the support part 3242 of the automatic sealing part 324 leans outwardly, downwardly at least 5°, preferably 5° to 15° from its vertical axis. This configuration, when the fluid product starts to be discharged as the automatic sealing valve 324 rises by pressure application, also prevents the automatic sealing valve 324 from being turned over (upwardly, convexly distorted). More particularly, as shown in FIG. 3B, when the automatic sealing valve 324 can rise no longer as the pressure is applied, the outer surface (S) of the support part 3242 comes into contact with the inner surface of the distorted vertical extending part 3224 thereby preventing the overturn of the automatic sealing valve 324. At this point, the pressurized fluid product can lead distortion of the flexible lateral part 322 and the support part 3242 no longer, and thus cause only open of the opening-closing slit 3246 so as to discharge the fluid product. If the support part 3242 rises beyond the vertical extending part 3224, the recovery process cannot easily occur when the pressure is released. Accordingly, the thickness of the flexible lateral part 322, the reverse dome shape of the top surface of the automatic sealing valve 324, and the slope degree of the outer surface (S) of the support part 3242 work together to perform the discharge process in pressure application and the recovery process in pressure release, respectively.

Referring again to FIGS. 1A and 1B, a cap 400 is connected to an area, with a snap hinge 410, in which the cylindrical body 210 of the closure body 200 meets the spout 220. The cap 400 works as protecting the automatic sealing valve 300 and also preventing the fluid product from being discharged by the unexpected external force to the container 500. In the interior of the cap 400, a first protruder 420 is formed having the height sufficient to suppress distortion of the automatic sealing valve 300, and a second protruder 430 is concentrically formed surrounding the first protruder 420. When the cap 400 is put over the closure body 200, the top 226 of the closure body 200 and the flexible lateral part 322 of the automatic sealing valve 300 are positioned in a groove 425 between the first protruder 420 and the second protruder 430, and the first protruder 420 presses the automatic sealing valve 318, so that, even when the fluid product in the container 500 is pressurized, the flexible lateral part 322 is not distorted and the opening-closing slit 3246 of the automatic sealing part 324 keeps closed.

Moreover, for easier opening of the cap 400, a portion 210' which is opposite to the snap hinge 410 in the closure body 200 is somewhat recessed to form a recess 216, and a lip 440 corresponding to the recess 216 is formed on the cap 400. Therefore, the cap 400 can be easily opened from the closure body 200 with the recess 216 and the lip 440.

Figure 4A:
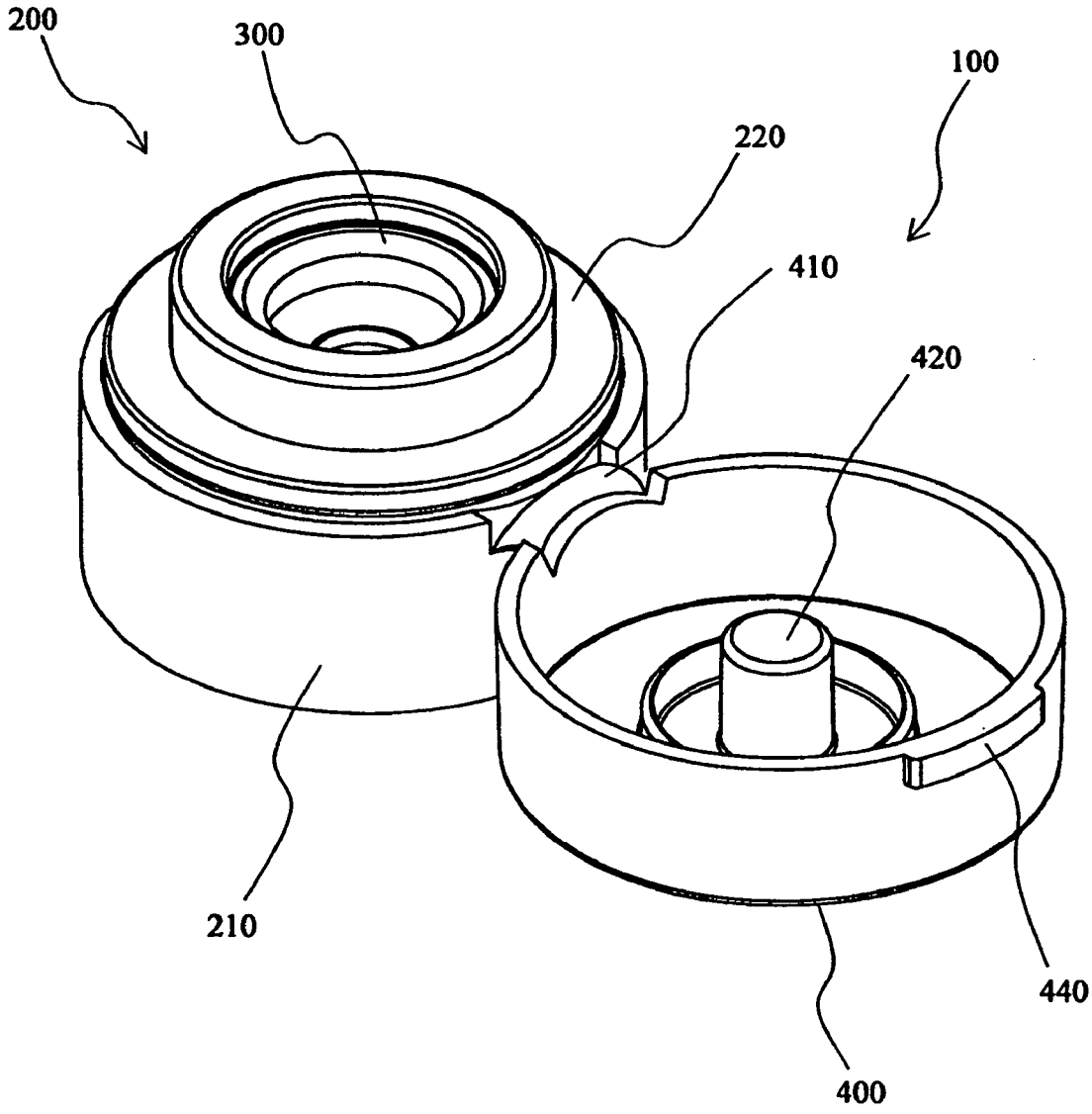
FIGS. 4A and 4B illustrate perspective views of a dispensing closure according a particular embodiment of the present invention.
Figure 4B:
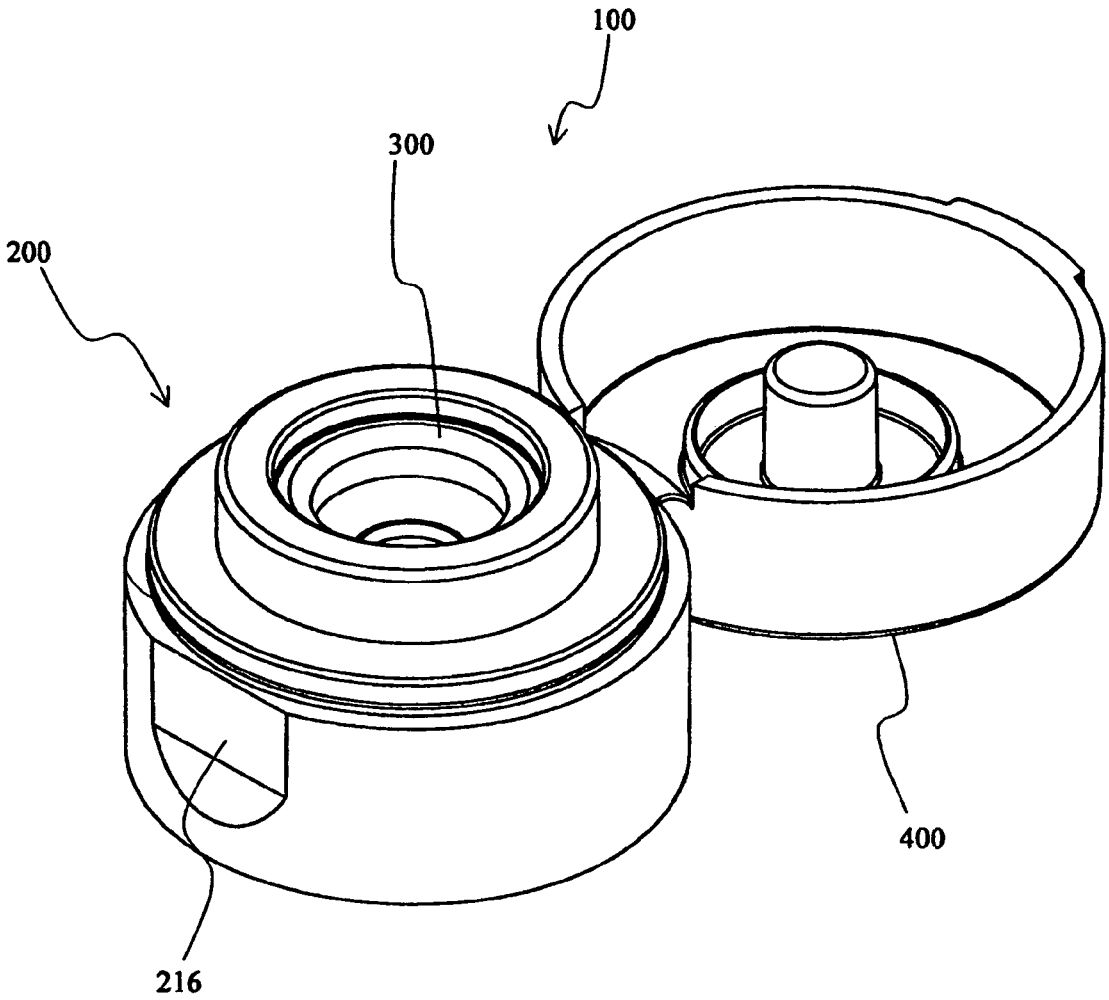

FIGS. 4A and 4B shows perspective views of a dispensing closure according to one embodiment of the present invention. The three-dimensional configuration of the dispensing closure 200 as seen in FIG. 1A can be more easily understood.

EFFECT OF THE INVENTION

The dispensing closure with the automatic sealing valve of a single body according to the present invention can be attached to containers for a wide range of fluid products such as beverages, foods, cosmetics, detergents, etc., to dispense the fluid products by squeezing the container. Compared to the prior art dispensing closures, the dispensing closure according to the present invention need not a separate retaining means for engaging the automatic sealing valve within the closure body, so that the number of components is relatively small and the assembling process is very simple. Furthermore, the structural configuration according to the present invention can significantly reduce the possibility of defect in manufacture and the possibility of disorder during use.

While there have been shown and described what are believed at the present time to be preferred embodiments of the present invention, it will be evident to one of ordinary skill in the art that various modifications may be made without departing from the scope of the invention as it is defined by the appended claims.

The invention claimed is:

1. A dispensing closure comprising:

a closure body to be assembled to an opening of a container, said closure body defining a dispensing passage for communication between an interior and an exterior of the container through the opening of the container; and an automatic sealing valve disposed in said closure body across said dispensing passage, said valve opening in response to increased container pressure and automatically closing in response to released container pressure;

(a) said closure body integrally comprising a cylindrical body for attachment to said container, a horizontal covering part extending inwardly from the top of said cylindrical body, a vertical covering part extending upwardly from the inner end of said horizontal covering part, and a top covering part extending inwardly from the upper end of said vertical covering part and protruding downwardly at its lower surface, which forms a generally tubular spout; and (b) said automatic sealing valve having a static member engaging in an inside space made by said horizontal covering part, vertical covering part and top covering part of said closure body, and a dynamic member being moved by pressure within said container between an open position and a closed position; wherein said static member comprises a horizontal part corresponding to said horizontal covering part and a vertical part corresponding to said vertical covering part, and said dynamic member comprises a flexible lateral part extending inwardly from the top of said vertical part and then bending downwardly, and an automatic sealing part extending inwardly from said flexible lateral part and having a central opening-closing slit; and the top surface of a connect portion between said vertical part and said flexible lateral part has a substantially V-shaped groove, and the thickness of said flexible lateral part is less than ⅓ of the thickness of said vertical part and simultaneously less than ⅓ of the thickness of the peripheral portion of said automatic sealing part, and the top surface of said automatic sealing part forms the shape of a reverse dome, and the outer, peripheral surface of said automatic sealing part slopes outwardly, downwardly at least 5° from its vertical axis.

2. The dispensing closure according to claim 1, wherein the thickness of said flexible lateral part is less than ¼ of the thickness of said vertical part and simultaneously less than ¼ of the thickness of the peripheral portion of said automatic sealing part.

3. The dispensing closure according to claim 1, wherein the outer, peripheral surf ace of said automatic sealing part slopes outwardly, downwardly in a range of from 5° to 15° from its vertical axis.

4. The dispensing closure according to claim 1, wherein said cylindrical body of the closure body further includes an annular, small ring which protrudes inwardly from the inner surface of the cylindrical body with which said horizontal part of the automatic sealing valve comes into contact.

5. The dispensing closure according to claim 1, wherein said dispensing closure further includes a cap for protection of said automatic sealing valve and being connected to said cylindrical body of the closure body through a snap hinge, said cap having a central post which is disposed within a cavity defined above the top surface of said automatic sealing valve when the cap is closed thereover.

* * * * *